US005359010A

United States Patent [19]

Calcaterra et al.

[11] Patent Number: 5,359,010

[45] Date of Patent: Oct. 25, 1994

[54] METHOD TO IMPART COFFEE STAIN RESISTANT TO POLYAMIDE TEXTILE SUBSTANCES

[75] Inventors: Lidia T. Calcaterra; Mathias P. Koljack, both of Arlington Heights; Qamardin Farishta, Bensenville; Michael G. Koehler; William B. Bedwell, both of Chicago, all of Ill.; Dale A. Hangey, Midlothian, Va.; George D. Green, Park Ridge, Ill.

[73] Assignee: AlliedSignal Inc., Morris Township, Morris County, N.J.

[21] Appl. No.: 988,506

[22] Filed: Dec. 10, 1992

Related U.S. Application Data

[62] Division of Ser. No. 894,702, Jun. 5, 1992, which is a division of Ser. No. 500,813, Mar. 27, 1990, Pat. No. 5,135,774.

[51] Int. Cl.[5] ..... C08F 222/20; C08F 222/08

[52] U.S. Cl. ..... 525/327.8; 526/271; 526/784; 526/318.2

[58] Field of Search ..... 525/327.8; 526/284, 526/271, 318.2, 318.4, 318.41

[56] References Cited

U.S. PATENT DOCUMENTS

| | | | |
|---|---|---|---|
| 3,409,589 | 11/1968 | Kine et al. | 526/271 X |
| 3,575,925 | 8/1971 | Skoultchi | 526/284 X |
| 3,835,071 | 9/1974 | Allen et al. | 252/545 |
| 4,144,026 | 3/1979 | Keller et al. | 8/115.6 |
| 4,501,591 | 2/1985 | Ucci et al. | 8/495 |
| 4,579,762 | 4/1986 | Ucci | 428/95 |
| 4,680,212 | 7/1987 | Blyth et al. | 428/97 |
| 5,001,004 | 3/1991 | Fitzgerald et al. | 428/263 |

FOREIGN PATENT DOCUMENTS

| | | |
|---|---|---|
| 0328822 | 8/1989 | European Pat. Off. . |
| 0329899 | 8/1989 | European Pat. Off. . |
| 3911405 | 10/1989 | Fed. Rep. of Germany . |
| 8902949 | 4/1989 | PCT Int'l Appl. . |
| 2055110 | 5/1979 | United Kingdom . |

OTHER PUBLICATIONS

CA95(4): 33400V.

CA 112(16): 149035d.

*Primary Examiner*—Mark Nagumo

*Attorney, Agent, or Firm*—Wayne W. Rupert

[57] ABSTRACT

The present invention provides methods and compositions to impart coffee stain resistance to polyamide textile substrates such as carpets. The compositions comprise either (i) a copolymer selected from the group consisting of a hydrolyzed aromatic-containing vinyl ether maleic anhydride copolymer, a half ester of an aromatic-containing vinyl ether maleic anhydride copolymer, and mixtures thereof, or (ii) an aromatic-containing acrylate copolymerized with an acid selected from the group consisting of acrylic acid and maleic acid. The coffee stain-resistant polyamide textile substrates made are also part of the invention.

4 Claims, No Drawings

METHOD TO IMPART COFFEE STAIN RESISTANT TO POLYAMIDE TEXTILE SUBSTANCES

This application is a division, of application Ser. No. 894,702, filed Jun. 5, 1992, which is a division of application Ser. No. 500,813 filed Mar. 27, 1990, issued Aug. 4, 1992 as U.S. Pat. No. 5,135,774.

BACKGROUND OF THE INVENTION

1. Field of the Invention

The present invention relates to methods and compositions to impart coffee stain resistance to polyamide textile substrates, as well as to the treated substrates themselves. More particularly, the present invention relates to compositions useful in imparting coffee stain resistance to polyamide textile substrates, such as carpets, the compositions comprising either (i) a copolymer selected from the group consisting of a hydrolyzed aromatic-containing vinyl ether maleic anhydride copolymer, a half ester of an aromatic-containing vinyl ether maleic anhydride copolymer, and mixtures thereof, or (ii) an aromatic-containing acrylate copolymerized with an acid selected from the group consisting of acrylic acid and maleic acid.

2. The Prior Art

Polyamide textile substrates, such as carpeting and upholstery fabrics, may be permanently discolored or stained by certain colorants, like food or beverage dyes. It is known to use sulfonated aromatic formaldehyde condensates (a) in a yarn finish, during or after fiber quenching (U.S. Pat. No. 4 680 212), (b) in a dye bath (U.S. Pat. No. 4 501 591), or (c) incorporated into the fiber (U.S. Pat. No. 4 579 762), all for the purpose of improving stain resistance of carpet fiber. Use of fluorochemicals in combination with sulfonated aromatic formaldehyde condensates to improve stain and soil resistance is taught in U.S. Pat. No. 4 680 212. Commonly assigned U.S.S.N. 101 652, filed Sep. 28, 1987 now abandoned, (International Publication No. WO 89/02949), discloses improved methods, utilizing application of sulfonated aromatic condensates, to enhance stain resistance of dyed nylon carpet fiber. These documents are all hereby incorporated by reference.

In the prior art the stain blocking performance of compositions is typically determined by testing for resistance to FD&C Red Dye 40, which is found in Cherry Kool-Aid ® drink product, as well as in other beverages and foods. Those compositions which are effective in enhancing the stain resistance of the substrate to FD&C Red Dye 40 are then described as "stain blockers". Applicants have discovered, however, that not all "stain blockers" which are effective against staining by FD&C Red Dye 40 are effective in enhancing the stain resistance of the substrate to coffee.

The present invention was developed as a consequence of a need for a stain blocker which would be effective in resisting hot coffee stains, preferably in addition to resisting Red Dye 40 stains.

BRIEF DESCRIPTION OF THE INVENTION

This invention is a composition useful in imparting coffee stain resistance to polyamide textile substrates. The composition comprises a copolymer selected from the group consisting of a hydrolyzed aromatic-containing vinyl ether maleic anhydride copolymer, a half ester of an aromatic-containing vinyl ether maleic anhydride copolymer, and mixtures thereof. By the hydrolyzed copolymer, or hydrolysis product, is meant the hydrolyzed copolymer in which some, preferably less than about 25 to 50 percent, of the original anhydride units remain as anhydride. By the half ester is meant the esterification product of the copolymer with a lower alcohol, preferably a C1–C5 alcohol, most preferably isopropyl alcohol, in which some, preferably about 25 to 50 percent, of the original anhydride units remain as anhydride and in which the reacted anhydride units are monoesterified. The copolymer has a weight average molecular weight between about 1,200 and 23,000, preferably between about 1,200 and 15,000, more preferably between about 2,000 and 10,000 and most preferably between about 2,000 and 4,000. The weight average molecular weight is determined by Gel Permeation Chromatography (hereafter "GPC") by comparison with polystyrene standard using a set of Phenogel columns of the 10 micron particle size, covering a range of 50–500 angstroms pore diameter, 300 mm length, 7.8 mm I.D. and with tetrahydrofuran as eluent.

Preferred copolymers can be represented by the formula

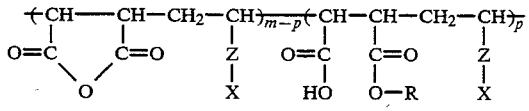

wherein m is 4 to 100, p is 0.5 m to 0.7 m, X is a moiety of an aromatic compound effective to improve stain resistance, R is alkyl or hydrogen and Z is either -0- or $-O-CH_2-CH_2-O-$. Preferably m is 2 to 20, X is selected from the group consisting of phenyl, naphthyl, and a partially saturated naphthyl-like ring, and R is $C_1$–$C_5$. When X is selected from the group consisting of 5,6,7,8-tetrahydro-1-naphthyl and 5,6,7,8-tetrahydro-2naphthyl, then Z is preferably $-O-CH_2-CH_2-O-$ and R is preferably $C_1$–$C_3$. When X is selected from the group consisting of 1-naphthyl and 2-naphthyl, and R is $C_1$–C5, then Z is preferably $-O-CH_2-CH_2-O-$. When X is phenyl, and R is C1-C5, Z can be either $-O-CH_2-CH_2-O-$ or -O-, preferably the latter.

The present invention is also a method of imparting improved coffee stain resistance to a polyamide textile substrate comprising treating the substrate with an effective amount of a copolymer selected from those set forth above, i.e., a hydrolyzed aromatic-containing vinyl ether maleic anhydride copolymer, a half ester of an aromatic-containing vinyl ether maleic anhydride copolymer, and mixtures thereof. The preferred copolymers are also as set forth above. The amount of the copolymer added to the substrate ranges from about 0.2 to 3.0, preferably 1.5 to 3.0 percent based on the weight of the substrate. When the substrate is treated with the half ester of phenyl vinyl ether maleic anhydride copolymer, the copolymer preferably is applied to the substrate in an aqueous solution at a temperature ranging from about 20 to 90° C., preferably 50 to 90° C., and having a pH ranging from about 2 to 9. The degree of coffee stain resistance imparted depends on the application pH. The optimum pH depends on the form the material appears to take when applied. If the material appears to be in a dispersion, then application pH can be about 2 to 5; if the material appears to be in solution, then application pH can be about 4 to 9, preferably 5 to 7, most preferably 5 to 6.

This invention is also a coffee stain-resistant polyamide textile substrate, preferably a nylon-6 substrate, having deposited thereon an effective amount of a composition which imparts coffee stain resistance to the substrate. The composition comprises a copolymer as set forth above. When the copolymer is either the half ester or the hydrolysis product of 2-(phenoxy) ethyl vinyl ether maleic anhydride copolymer or of phenyl vinyl ether maleic anhydride copolymer, the substrate has improved resistance to dye fading upon exposure to ozone and light, and does not yellow on exposure to UV light or oxides of nitrogen. When the copolymer is the half ester or the hydrolysis product of phenyl vinyl ether maleic anhydride copolymer, the substrate also has excellent resistance to staining by FD&C Red Dye 40.

In another embodiment, this invention is another composition useful in imparting coffee stain resistance to polyamide textile substrates. This composition comprises an aromatic-containing acrylate copolymerized with an acid selected from the group consisting of acrylic acid and maleic acid. The copolymer has a weight average molecular weight between about 2,000 and 15,000, determined by GPC as previously set forth.

Preferred copolymers for this embodiment can be represented by the formula

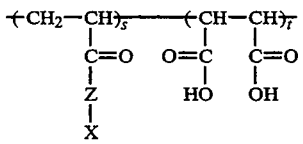

wherein s is 2 to 50 and t is 2 to 50, X is a moiety of an aromatic compound effective to improve stain resistance, and Z is either -O- or -O-CH2-CH2-O-. Preferably, X is selected from the group consisting of phenyl, naphthyl, and a partially saturated naphthyl-like ring. When X is selected from the group consisting of 5,6,7,8-tetrahydro-1-naphthyl and 5,6,7,8-tetrahydro-2naphthyl, then Z is preferably -O-$CH_2$-$CH_2$-O-. When X is selected from the group consisting of 1-naphthyl and 2-naphthyl, then Z is preferably -O-$CH_2$-$CH_2$-O-. When X is phenyl, Z can be either -O-$CH_2$-$CH_2$-O- or -O-, preferably the latter.

This invention is also a method of imparting improved coffee stain resistance to a polyamide textile substrate comprising treating the substrate with an effective amount of a copolymer selected from those of the second embodiment above, i.e. an aromatic-containing acrylate copolymerized with an acid selected from the group consisting of acrylic acid and maleic acid. The preferred copolymers are as set forth. The amount of the copolymer added to the substrate ranges from about 0.2 to 3.0, preferably 1.5 to 3.0, percent based on the weight of the substrate.

This invention is also a coffee stain resistant polyamide textile substrate having deposited thereon an effective amount of a composition which imparts coffee stain resistance to the substrate. The composition comprises a copolymer of the second embodiment above. It is expected that the substrate will not yellow on exposure to light when the copolymer has the formula

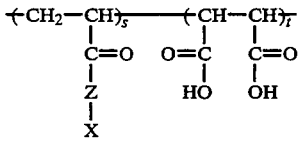

wherein s is 2 to 50 and t is 2 to 50, X is phenyl, and Z is either -O- or -O-$CH_2$-$CH_2$-O-.

This invention is also a method to apply a polymer, preferably a stain blocker, to the surface of polyamide fibers comprising preparing an aqueous dispersion of microfine polymer beads and causing said beads to contact said fiber by electrostatic attraction to coat said fiber, then heating the coated fiber. It is preferred that the aqueous dispersion be prepared by dissolving the polymer into a water-soluble solvent, preferably an organic solvent such as acetone, tetrahydrofuran and/or an alcohol, most preferably acetone, followed by injecting the solution into water, whereby the polymer precipitates to form microfine beads which are smaller then about 2 microns. The solvent is then evaporated to leave a dispersion of microfine polymer beads in water. The dispersion has a pH in the range of about 2.0 to 7.0, preferably 2.0 to 3.0. The heating temperature is in the range 70° C. to 200° C., preferably 100° C. to 135° C.

The following terms are defined for use in this specification.

By polyamide is meant nylon 6, nylon 6,6 nylon 4, nylon 12 and the other polymers containing the

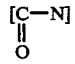

structure along with the chain. Nylon 6 and 6,6 are preferred.

By textile substrate is meant fiber or yarn which has been typically tufted, woven, or otherwise constructed into fabric suitable for final use in home furnishings, particularly as floor covering or upholstery fabric.

By fiber is meant continuous filament of a running or extremely long length, or cut or otherwise short fiber known as staple. Carpet yarn may be made of multiple continuous filaments or spun staple fiber, both typically pretextured for increased bulk.

DETAILED DESCRIPTION OF THE INVENTION

In the preferred embodiment coffee stain resistance is imparted to a nylon 6 textile substrate, by the hydrolysis product, the half ester, or mixtures thereof, of copolymers made from vinyl ethers and maleic anydride in which the vinyl ether contains an aromatic ring structure. These copolymers can be represented by the formula

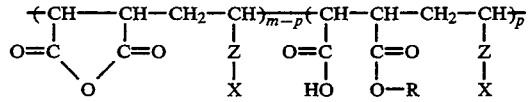

wherein m is 4 to 100, p is 0.5m to 0.7m, X is a moiety of an aromatic compound effective to improve stain resistance, R is alkyl or hydrogen and Z is either -O- or -O-$CH_2$-$CH_2$-O-. X preferably is phenyl, naphthyl or a partially saturated naphthyl-like ring.

The most preferred copolymer is prepared from phenyl vinyl ether and maleic anhydride. These are typically 1:1 alternating copolymers. The hydrolysis product of this copolymer is preferred for resistance to FD&C Red Dye 40 staining, whereas the half ester product, preferably the half isopropyl ester product, of this copolymer is preferred for resistance to hot coffee staining, although each product provides protection against both types of staining. Substrates treated with these most preferred copolymers have the added advantages of not yellowing on exposure to UV light or oxides of nitrogen, and of resistance to dye fading upon exposure to ozone or light.

Alkali metal hydroxides, such as sodium, potassium, and lithium preferably the former, are suitable hydrolyzing agents for making the hydrolysis product. Alcohols, such as the $C_1$–$C_5$ alcohols, preferably isopropyl alcohol, are suitable hydrolyzing agents for making the half ester product of the copolymer.

In the second less preferred embodiment of this invention, coffee stain resistance is imparted to a nylon 6 textile substrate by an aromatic-containing acrylate copolymerized with either acrylic acid or maleic acid. The more preferred copolymers, which can be random or block, made with maleic acid, can be represented by the formula

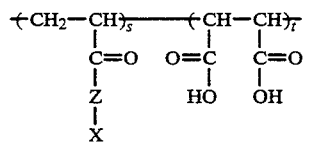

wherein s is 2 to 50 and t is 2 to 50 (this is not necessarily an alternating copolymer), X is a moiety of an aromatic compound effective to improve stain resistance, and Z is either -O- or -O-$CH_2$-$CH_2$-O-. X preferably is phenyl, naphthyl, or a partially saturated naphthyl-like ring.

The copolymers of all of the embodiments are readily soluble, even at high concentrations, in water at neutral to alkaline pH; increasing dilution is needed at pH below 6.

The copolymers of this invention can be used as such in treating polyamide textile substrates. They can be applied to dyed, and possibly undyed, polyamide textile substrates. They can be applied to such substrates in the absence or presence of polyfluoroorganic oil-, water-, and/or soil-repellent materials. In the alternative, such a polyfluoroorganic material can be applied to the textile substrate before or after application of the copolymers of this invention thereto. The copolymers can be applied to textile substrates in a variety of ways, e.g. during conventional beck and continuous dyeing procedures. The quantities of the polymers of this invention which are applied to the textile substrate are amounts effective in imparting coffee stain-resistance to the substrate. The amounts can be varied widely; in general, one can use between 0.2 and 3% by weight of them based on the weight of the textile substrate, preferably 1 to 3%, more preferably 1.5 to 3.0%. The copolymers can be applied, as is common in the art, at pHs ranging between 2 and 9.

The copolymers of this invention can also be applied in-place to polyamide carpeting which has already been installed in a dwelling place, office or other locale. They can be applied as a simple aqueous preparation at the levels described above, at temperature described, and at a pH between about 1 and 12, preferably between about 2 and 9. Heating after application is preferred but not necessary for performance. Steam treatment after application does not adversely affect performance.

Staining and test procedures utilized in the Examples were as follows.

TESTING PROTOCOLS

Unless noted otherwise, the fabric samples were a 3.4 g, 2.5 inch wide nylon 6 fabric (plain weave, 12–13 ends/inch × 11–12 picks/inch) woven from Allied Type 1189-7B39/2 ply Superba heatset [at 270° F. with presteam] yarn. The fabric was beck dyed into a 1/25 Standard Depth Neutral Grey Shade using C.I. Acid Orange 156, C.I. Acid Red 361 and C.I. Acid Blue 324. The samples were about 3 to 4 inches long.

A. COFFEE

A brew of coffee was prepared using 20g of Maxwell House Master Blend Auto Drip coffee per 500 mL of water. Thirty milliliters of this coffee solution at 71° C. was dropped from a 12 inch height onto a fabric samples. After one minute the coffee solution was drained and the stain was allowed to remain on the fabric for 4 hours. Then the fabric was rinsed with cold tap water.

1. The coffee stain resistance of early samples was measured by the following technique: A 0–10 scale was used to rate the stain protection, with a score of 0 for a stain similar to stain in a control (no protection) nylon-6 fabric, and a rating of 10 when the stain was not detectable. The rating was done by visual evaluation by the same panel of evaluators.
2. The coffee stain resistance of later samples was measure using a photovolt single filter colorimeter, as follows. The stain protection of the samples was evaluated using the red (R), green (G), and the blue (B) reflected light values measured with a photovolt single filter colorimeter. The RGB values from the stained, tested samples were referenced to those of a stained control and related in a quantitative form to an unstained fabric sample. The RGB data of each sample represented a color response vector in an RGB tridimensional space. The stain value of each sample was computed from the length of each response vector. The vector length was calculated as follows: Length (i)=SquareRoot (Square(R(i))+Square(G(i))+Square(B(i)) ) where i was the test sample. The stained control was the darkest sample and was represented by the shortest vector. The maximum length vector was derived from the RGB vector of the unstained sample. The stain protection performance of the same is then given by Stain Protection (i)=

$$\text{Stain Protection } (i) = \left[\frac{(\text{Length}(i) - \text{Minimum Length Vector}}{(\text{Max. Length Vector} - \text{Min. Length Vector})}\right] \times 100$$

The stain protection is reported in percent, for comparison with the unstained, untreated fabric sample (at 100%) and the stained control (at 0%).

B. FD&C RED DYE 40

1. Unsweetened cherry Kool-Aid ® (0.14 oz) was dissolved in two quarts of water. Thirty milliliters of this solution was poured on a (2.5 inch piece of nylon-6 fabric weighing 3.4 g) from a 12 inch height. After one minute the Kool-Aid was drained and the stain was allowed to remain on the fabric for 4 hours. Then the stain was removed by rinsing the fabric with cold tap water. FD&C Red Dye 40 stain resistance for samples stained in this manner was measured on a 0–10 scale like Technique 1 for coffee above.

2. Unsweetened cherry Kool-Aid (0.14 oz) was dissolved in two quarts of water. Twenty milliliters of this solution were placed in a vial, and a 3.4 g blue grey nylon-6 flat fabric was immersed in this solution with agitation to achieve wetting of the fabric. The fabric was left in contact with this solution for 1.5 minutes and then it was removed and placed in a beaker. The remaining solution was combined with another 5 mL of Kool-Aid solution and it was poured onto the soaked flat fabric from a 12" height. After one minute, the Kool-Aid solution was drained, and the sample was allowed to stand for 4 hrs. At the end of this period the sample was rinsed with cold water and left to dry. FD&C Red Dye 40 stain resistance for samples stained by this procedure was measured using a photovolt single filter colorimeter, like Technique 2 for coffee, above.

C. Colorfastness to light (Yellowing) was measured in accordance with AATCC Test Method 16E-1987, at 40 fading units.

D. Ozone fastness was measured in accordance with AATCC 129–1985.

E. $NO_2$ fastness was measured in accordance with AATCC 164–1987.

F. Application Methods

1. Solvent Application

A known weight percent of the stain blocker oligomer per weight of fiber (typically 2–4%) was dissolved in 5–10 mL of tetrahydrofuran and diluted to 150 mL with trifluorotoluene. A nylon-6 fabric sample was immersed in half the amount of the above solution, and heated in a steam bath for 15 min. Then the sample was retrieved from the remaining liquid and dried with a hot (40°–90° C.) stream of nitrogen. The remainder of the liquid was mixed with the second half of oligomer solution and this was sprayed over the sample. The treated sample was then dried with a stream of nitrogen, and annealed for 15 min at 105° C.

2. Aqueous Application (a) The oligomeric stain blocker was dissolved in water at basic pH (e.g. 8–10) and then brought to acidic pH (2–7) with acetic or sulfamic acid. At acidic pH the stain blocker adsorbs onto nylon 6 with a rate of adsorption depending on the temperature and pH of the dispersion/solution.

(b) A 10% solution of the stain blocker in water can be made using NaOH (0.73 eq. NaOH per vinyl ether unit). This solution can be brought to a pH of between 5.5 and 6.5 and diluted with water typically to a 1.3% Stain Blocker solution. Nylon 6 flat fabric is then impregnated with said solution at 65°–75° C. for 1 to 2 min, to give, after squeezing the fabric between two rollers, a take up of 2.8% stain blocker per weight of fabric. The fabric is then annealed at 250° F. for 15 min.

(c) A dispersion is generated by spraying a solution of 1 g of copolymer in 50 mL of acetone into 50 mL of water. The acetone is evaporated to leave an aqueous dispersion of submicron beads. This dispersion is diluted to 1% with water at a pH of 2.0. One gram of nylon 6 fabric is soaked for about 20 minutes in 20 mL of this suspension at 45° C. and then annealed at 135° C. for 15 minutes.

PREPARATION OF STAIN BLOCKERS

Preparation of Saturated Naphthyl Derived Ring Systems by Hydrogenation:

The reduction of the naphthalene rings to yield 5,6,7,8 tetrahydronaphthalene derivatives was done by low pressure catalytic hydrogenation in methanol. The hydrogenations were carried out with the naphthol, naphthoxyethanol, or naphthyl ethyl derivatives. Except for 2-(2-naphthyl) ethanol, the reduction of the first ring was accomplished using 5% rhodium on carbon catalyst (R h/C), 60 psi $H_2$, 60° C., until complete reduction of the unsubstituted ring was observed by gas chromatography (GC). To hydrogenate the 5,6,7,8 position of 2-(2-naphthyl) ethanol it was necessary to use palladium on carbon catalyst (Pd/C), since rhodium is not active enough.

Preparation of Vinyl Ether Derived Stain Blockers:

Except for phenyl vinyl ether, the vinyl ether monomers were prepared either by reaction of the appropriate alcohol with 2-chloroethyl vinyl ether or by transvinylation using palladium acetate phenanthroline catalyst. These methods are presented below. Phenyl vinyl ether was prepared according to the method of Mizuno et al., *Synthesis,* 1979, 688, by dehydrohalogenation of phenyl-2-bromoethyl ether with aqueous sodium hydroxide by utilizing the phase-transfer ability of tetra-n-butylammonium hydrogen sulfate. The reaction is exothermic and is completed within 1.5 hours at ambient temperature.

Preparation of 2-(2-Naphthoxy) Ethyl Vinyl Ether) via reaction with 2-chloroethyl vinyl ether):

Three pounds of 2-naphthol were placed in a three necked round bottom flask equipped with an overhead stirrer and a reflux condenser. One liter of dimethyl sulfoxide was used to dissolve the naphthol and to this solution was slowly added 0.8 lb. of NaOH, while keeping the temperature below 50° C. After the addition of NaOH was completed, 1.1 liters of 2-chloroethyl vinyl ether were added slowly while keeping the temperature at 60° C. The reaction mixture was heated at this temperature for 20 hours (the progress of the reaction was followed by GC). After cooling the reaction product was poured into a polyethylene decantation tank and water was added to separate the product. Toluene was added to dissolve the product, and the toluene phase was washed several times with enough 5% NaOH to remove any residual naphthol starting material. The toluene layer was dried with anhydrous $Na_2SO_4$ filtered and the toluene was evaporated. The product was identified by GC. A product yield of approximately 85% based on the weight of the naphthol starting material was obtained with this procedure.

Preparation of (2-Naphthyl) Methyl Vinyl Ether (via transvinylation catalyst):

a. Preparation of Palladium Acetate Phenanthroline Catalyst:

Pd(II) acetate, 3.36 g (0.01497 moles), was dissolved in 375 mL of benzene, and filtered through fluted filter paper giving a brown transparent solution. To this was added, dropwise, under nitrogen, a solution of 2.7 g (0.1498 moles) anhydrous 1,10-phenanthroline in 125 mL of benzene. A yellow precipitate resulted, which was filtered off and washed with benzene to obtain 4.7 g of a pale yellow solid.

b. Vinyl Ether Monomer Preparation:

In a three necked round bottom flask equipped with a thermometer, condenser, and magnetic stirrer were added 16 g (0.1 moles) of 2-naphthalene methanol, 200 mL of butyl vinyl ether and 1.0 g of palladium (Pd(II)) acetate phenanthroline. The reaction mixture was stirred overnight while the reaction progress was followed by GC. When conversion was 85% or higher, the catalyst was removed with activated charcoal. After separating the catalyst by filtering, the butanol and the unreacted butyl vinyl ether were removed by distillation. The vinyl ether product was purified to 97%+purity by column chromatography on silica gel using hexane/2% ethyl ether.

Vinyl Ether and Maleic Anhydride Copolymer:

The copolymers were prepared in 1,2-dichloroethane, using VAZO 67, 2,2'-azo-bis-(2 methylbutyronitrile) as initiator, and butanethiol or dodecanethiol as the chain transfer agent to control the degree of polymerization.

Preparation of 2-(2-Naphthoxy Ethyl Vinyl Ether/Maleic Anhydride Copolymer:

2-(2-naphthoxy) ethyl vinyl ether (20.0 g, 0.09524 moles), and maleic anhydride (9.33 g, 0.09524 moles) were dissolved in (155 mL) dichloroethane. The solution was placed in a three necked round bottom flask equipped with a thermometer, a condenser, and nitrogen inlet, and purged with nitrogen for half an hour. Then VAZO 67 (0.61 g, 0.003175 moles) and butanethiol (4.08 mL, 0.93799 moles) were added under nitrogen. The polymerization was carried out at 60° C. for 24 hrs or longer until complete monomer conversion. The polymer was isolated by precipitation in hexane.

Preparation of the Isopropyl Monester of 2-(2-Naphthoxy) Ethyl Vinyl Ether/Maleic Anhydride Copolymer:

The anhydride copolymer was dissolved in the minimum amount of tetrahydrofuran. The solution was diluted with toluene, and then isopropanol. The solution was refluxed, until 50–75% of the monoester was formed as determined by infra red (IR) or by carbon 13 nuclear magnetic resonance ($^{13}C$ NMR). The copolymer was recovered by precipitation. The average molecular weight of the copolymer was determined by gel permeation chromatography (GPC).

Acrylate Derived Stain Blockers:

The acrylate monomers were prepared by the reaction of the corresponding alcohols with acryloyl chloride as described below.

Preparation of 2-(2-Naphthoxy) Ethanol:

The reaction set-up consisted of a three necked round bottom flask, equipped with a thermometer, condenser and a mechanical stirrer, and a dropping funnel. 2-Naphthol, 100 g (0.6936 moles), was dissolved in 60 mL of dimethyl sulfoxide. Sodium hydroxide, 27.7 g (0.6936 moles), was carefully added to the solution. Then 2-chloroethanol, 61.4 g (0.7629 moles), was slowly added, keeping the reaction temperature at 80° C. The reaction was followed by GC. After >>80% conversion was achieved, the reaction was worked-up by adding toluene and extracting the unreacted naphthol with 5% aqueous NaOH. The product was then recrystallized in ethanol or distilled under vacuum (70–80% yield).

Preparation of 2-(2-Naphthoxy) Ethyl Acrylate:

In a round flask provided with an overhead stirrer, condenser, and addition funnel 2-(2-naphthoxy) ethanol, 40.0 g (0.2127 moles), was added and the system was swept with nitrogen for 15 minutes, then a dry tube was placed in the outlet of the condenser to prevent moisture from getting into the system. Acryloyl chloride, 21.1 g (0.2340 moles), was added dropwise, and the solution was stirred overnight. The solution was worked-up by extracting the HCl formed with water, evaporating the solvent and purifying the product by distillation (84% yield). Further purification by column chromatography was necessary.

The polymerization was carried out under nitrogen, using 1,2-dichloroethane as the solvent, VAZO 67 as the initiator, and butanethiol as a chain transfer agent to control the degree of polymerization. A typical polymerization is described below.

Homopolymerization of 2-(2-Naphthoxy) Ethyl Acrylate:

The monomer, 3.0 g, was dissolved in 1,2 dichloroethane. The system was purged with nitrogen, and VAZO 67 , 30.6 mg (0.0002065 moles), and butanethiol, 0.53 mL (0.004942 moles), were added. The polymerization was carried out at 60° C. until total monomer conversion. The polymer was precipitated in hexane.

Preparation of 2-(2-Naphthoxy) Ethyl Acrylate/Maleic Diacid Copolymer:

2-(2-Naphthoxy) ethyl acrylate (3.0 g, 0.01239 moles) and maleic anhydride (1.21 g, 0. 01239 moles) were dissolved in 20.7 mL of dichloroethane. The solution was placed in a 100 mL three-necked round bottom flask equipped with a thermometer, condenser, stirring bar, and nitrogen inlet, and purged with nitrogen for half an hour. Then VAZO 67 (0. 159 g, 0. 000826 moles) and butanethiol (0.028 g, 0.000309 moles) were added under nitrogen. The polymerization was carried out at 60° C. for 24 hours until complete monomer conversion. The dichloroethane was then evaporated, a brown gummy solid was redissolved in tetrahydrofuran (15 mL) and added dropwise to 75 mL of ethanol to give once filtered, 1.86 g of a light brown solid. 1.20 g of this light brown solid, 20 mL of tetrahydrofuran, 3.0 mL $H_2O$, and 0.10 g of p-toluene sulfonic acid were added to a 50 mL single necked round bottom flask and the reaction was run at 80° C. with stirring overnight. IR analysis then indicated that only about 20% of the anhydride remained, and the main peak came at 1700 $CM^{-1}$ characteristic of a carboxylic acid group. The brownish solution was precipitated in 100 mL of hexane to give 1.5 g of a light brown solid (30–40% yield). The average molecular weight of the copolymer was determined by GPC.

EXAMPLE 1

With reference to Table 1, the copolymers listed were applied to a nylon 6 fabric sample by the solvent application method. These copolymers, which were each about 50–75% isopropyl monoester, had a number average molecular weight of about 5000–10,000. The fabric samples were tested for coffee stain resistance by Technique 1 set forth above, the 0–10 stain protection rating wherein 0 represents no protection and 10 represents complete protection. Data are presented in Table 1.

EXAMPLE 2

With reference to Table 2, the copolymers listed were applied to a nylon 6 fabric sample by the solvent application method. These copolymers, which were each 50–75% isopropyl monoester, had the number average molecular weights set forth in Table 2. The fabric samples were tested for coffee stain resistance by Technique 1 previously set forth. Data are presented in Table 2.

EXAMPLE 3

With reference to Table 4, the copolymers listed were applied to a nylon 6 fabric sample by the solvent application method. These copolymers, which were each 50–75% isopropyl monoester, had a number average molecular weight of about 5000–10,000. These fabric samples were then tested for lightfastness using AATCC method 16E-1987. Data are presented in Table 4.

EXAMPLE 4

With reference to Table 5, the copolymers listed were applied to a nylon 6 fabric sample via the solvent application method, modified as follows: the copolymer/trifluorotoluene solution was sprayed onto the sample to achieve about 3% of the copolymer based on the weight of the substrate. These copolymers, which were each about 50–75% isopropyl monoester, had a number average molecular weight of about 5,000–10,000. The fabric samples were tested for coffee stain resistance by Technique 2 set forth above, using a photovolt single filter colorimeter.

EXAMPLE 5

Best Mode

Fifteen grams of phenyl vinyl ether/maleic isopropyl monoester copolymer were added to 119 g of water to make a slurry. Then 15.6 g of a 10% NaOH aqueous solution were added, and the mixture was heated to 75° C. for 20 min. The solution was then allowed to cool to room temperature. A 10% w/w clear golden solution was obtained and the pH of this solution was around 6.0 to 6.5. This copolymer solution was diluted with water to a 1.32% w/v and the pH was adjusted to 5.8 with sulfamic acid. A grey nylon 6 flat fabric (3.4 g), was immersed in 50 g of the 1.32% weight by volume (w/v) aqueous copolymer solution at 70° C. for 3 minutes. The flat fabric was wrung out to a 237% weight pick-up, which resulted in a 3.1% polymer add-on per weight of fiber (wof). The flat fabric was then heated at 220°–250° F. for 20 minutes.

A sufficient number of fabric samples were prepared to test separately for resistance to coffee staining, resistance to FD&C Red Dye 40 staining, lightfastness, ozone fastness and resistance to the action of oxides of nitrogen. Data are presented in Tables 6 and 7 (sample 22).

For comparison, untreated control samples were stained with coffee and cherry Kool-Aid, respectively. These control samples and a blank are presented in Table 6.

EXAMPLE 6 (COMPARATIVE)

Twelve and a half grams of deionized water were added to 20 g of a styrene maleic anhydride copolymer (commercially available from Aldrich Chem. Co., Catalog No. 20060-3, 1600 weight average molecular weight, white solid, 1:1 ratio styrene to maleic anhydride) in a 250 ml three-necked round bottom flask, and stirred with an overhead stirrer to make a white slurry. Then 22.5 g of a 30% NaOH aqueous solution were added dropwise so as not to exceed 40° C. temperature in the flask. The flask was then heated to 70° C. and stirred for three hours. Then 11.6 g of deionized water were added to make a 30% concentrated solution. This solution was then allowed to cool to room temperature. A viscous, light yellow solution was obtained, and the pH of the solution was about 9.9. This copolymer solution was diluted with water to a 1.32% w/v and the pH was adjusted with acetic acid to 5. A blue-grey nylon-6 flat fabric (3.4 g, about 4 inches×2.5 inches) was immersed in 50 g of 1.32% w/v aqueous copolymer solution at about 85° C. for 5 minutes. The solution container was shaken once every minute. The flat fabric was wrung out to achieve about a 2.9% polymer add-on per weight of fabric. The sample was dried at about 200° F. for 25 minutes, without rinsing first since this adversely affected performance. A sufficient number of samples were prepared to test for coffee stain protection and FD&C Red Dye 40 stain protection using a photovolt single filter colorimeter. Data are presented in Table 6.

EXAMPLE 7

5.4 g phenyl vinyl ether/maleic anhydride were added to 13.2 g of water (in a 250 mL 3-necked round bottom flask) to make a slurry. Then 8.44 g of a 20% NaOH aqueous solution were added, and the mixture was heated to 75° C. for 2.5 hours with stirring by overhead stirrer. The solution was then allowed to cool to room temperature. A viscous, orange solution was obtained with a pH of about 9. This copolymer solution was diluted with water to a 1.32% w/v, and the pH was adjusted to 5 using a 5% acetic acid/water solution. Fabric samples were made as in Example 5 except that the polymer add-on per weight of fiber was about 3%. Samples were tested for stain resistance (%) to coffee and FD&C Red Dye 40, respectively, using a photovolt single filter colorimeter. Data are presented in Table 6 (Sample 24).

EXAMPLE 8

Example 7 was repeated, except that the pH was adjusted to 5.8. Data are presented in Table 6 (Sample 25) .

EXAMPLE 9

0.1 g of phenyl vinyl ether/maleic isopropyl monoester (number average molecular weight 4500) stain blocker was dissolved in 5 mL of 1% NaOH solution to make a 2% polymer in water solution, which was then diluted to 0.2% polymer in water. This diluted solution was then sprayed, using a thin layer chromatography (TLC) sprayer onto 500 mL of water at pH 2.0 (sulfamic acid), under constant stirring at 40° C. while keeping the overall pH at 2.0. This created a dispersion of the polymer in water. 2.5 g of a nylon-6 fabric were immersed in the polymer dispersion at 40° C. for 2 hours. The dispersion was not completely exhausted.

The coated fabric was dried in air and annealed at 120° C. for 30 minutes. Coffee stain test, Technique 1, gave a rating of 8.

EXAMPLE 10

A solution of 1 gram of phenyl vinyl ether/maleic isopropyl monoester copolymer in 50 mL of acetone was sprayed into 50 mL of water. The acetone was evaporated to leave an aqueous dispersion of submicron beads. This dispersion was diluted to 1% with water at pH 2. One gram of nylon-6 fabric was soaked in 20 mL of this suspension at 45° C. for 20 minutes and then annealed at 135° C. for 15 minutes. The resulting fabric sample showed good protection against coffee staining according to Technique 1.

EXAMPLES 11-12

Example 7 was repeated in Example 11 with the following modifications: The copolymer solution in which the fabric was immersed was at 75° C. rather than 70° C., and the flat fabric was heated at 90° C. for 20 minutes. The fabric was tested for stain reistance (%) to FD&C Red Dye 40 using a photovolt single filter colorimeter -protection was 99.3%.

Example 12 was a repeat of Example 11 except that the fabric was allowed to air dry at room temperature, about 25° C., i.e., there was not heating step. Protection level was 92.0%.

This set of examples demonstrates that the hydrolysis product of phenyl vinyl ether/maleic anhydride copolymer can be applied to an installed carpet to yield excellent protection against FD&C Red Dye 40 stains. The product can be applied by soaking the installed carpet with the product followed by air drying of the carpet. There is no need to provide extra heat in drying the carpet or as an added treatment to achieve good stain protection.

DISCUSSION

Applicants have found that coffee stain protection can be achieved when the vinyl ether monomer of the vinyl ether/maleic anhydride copolymer contains an aromatic ring (phenoxy, naphthyl or a partially saturated naphthyl-like ring). With reference to Table 1, it can be seen that straight chain hydrocarbons (Samples 3 and 2) provide little to no protection, but when the side chains include an aromatic ring system (Samples 4–6, 8–9, 11), there is good protection.

Applicants have also found that the aromatic ring of the copolymer must be bound to an oxygen as part of the chain connecting the ring to the polymer backbone. See samples 22–25 in Table 6 which demonstrate the superior coffee stain resistance of Samples 22,24 and 25 versus Sample 23. Also see Table 5, Samples 4 and 21.

The importance of an oxygen being part of the chain binding the aromatic ring of the copolymer to the polymer backbone is also seen with FD&C Red Dye 40 Stains. See Table 6 wherein Comparative Sample 23 does not have such an oxygen and has inferior performance to both of Samples 22 and 24 of the present invention.

Coffee stain protection was tested with coffee at a temperature of 71° C., i.e., with hot coffee. The samples in Table 3 demonstrate that having a glass transition temperature and/or a melt temperature greater than 71° C. is not required of the copolymer in order to achieve hot coffee stain protection.

While vinyl ether/maleic anhydride copolymers are considered the best mode of practicing this invention, it was also found that acrylate/maleic anhydride copolymers offer coffee stain protection; homoacrylates, however, did not protect against coffee stains. See Table 2. And although the protection offered by the copolymer of Sample 17 is only 4, this sample is included as part of the present invention since it was not an optimized structure; the monomers' ratio could probably be varied to provide improved performance.

The naphthoxy containing copolymers yellowed upon exposure to ultra violet (UV) light even when the oxygen in the naphthoxy or 5,6,7,8-tetrahydro-2-naphthoxy ring of the above mentioned copolymers was etherified. See Table 4. A phenoxy ring linked from the phenoxy oxygen (phenyl-0-) to the vinyl ether oxygen (O-CH=CH2 by a CH2CH2 group : (phenyl-O-CH2CH2-OCH=CH2) gave stain protection against coffee, although much lower than the protection given by the same naphthoxy arrangement (compare Samples 9 and 4 in Tables 1 and 4); however it had the advantage that it did not yellow. This was surprising because the 5,6,7,8 tetrahydro-2-naphthoxy ethyl vinyl ether/-maleic isopropyl monoester (Sample 6, Table 4), which could be considered an etherified dialkyl substituted phenoxy derivative, did yellow upon exposure to UV light.

A preferred stain blocker was obtained when a phenyl ring was linked directly to the vinyl ether oxygen. This arrangement with the oxygen from the phenoxy ring being the vinyl ether oxygen, gave the best combination of coffee stain protection with no yellowing upon exposure to UV light or oxides of nitrogen. See Tables 4, 5, 6 and 7.

The half ester, namely the half isopropyl ester of the vinyl ether/maleic anhydride copolymers gave better coffee stain protection than the hydrolysis product (see Table 6). This is in contrast with FD&C Red Dye 40 protection where both the half ester and the hydrolysis product of the anhydride copolymer gave excellent protection. Furthermore, each can be applied to achieve this protection as easily as soaking the carpet in an aqueous solution thereof, steaming the carpet if desired, and allowing to air dry.

It is possible that optimum performance against both types of stains may be obtained with a combination of the half ester and the hydrolysis product.

Effect of Molecular Weight on Performance

Using the compound of the invention, 2-(1-naphthoxy) ethyl vinyl ether/maleic isopropyl monoester copolymer, (50–75% monoester), of the following molecular weights, stain protection was evaluated as shown:

| Mol. Wt. $\times 10^3$ | Stain Protection* |
|---|---|
| less than 4.5 | 7 |
| 4.5 | 9–10 |
| 7.9 | 8–9 |
| 23 | 7–8 |

*by Technique 1 for Coffee Stains, above.

It is believed that the other compounds of this invention will show very similar results.

TABLE 1

| Sample | Copolymer | Coffee Stain Protection |
|---|---|---|
| 1 | Control | 0 |
| 2 (comparative) | Decyl vinyl ether/Maleic anhydride | 0 |
| 3 (comparative) | Docosyl vinyl ether/Maleic isopropyl monoester | 4–5 |
| 4 | 2-(2-Naphthoxy) ethyl vinyl ether/Maleic isopropyl monoester | 9–10 |
| 5 | 2-(1-Naphthoxy) ethyl vinyl ether/Maleic isopropyl monoester | 9–10 |
| 6 | 2-(5,6,7,8-Tetrahydro-2-naphthoxy) ethyl vinyl ether/Maleic isopropyl monoester | 8–9 |
| 7 (comparative) | 2-(2-Decahydro naphthoxy) ethyl vinyl ether/Maleic isopropyl monoester | 2 |
| 8 | Phenyl vinyl ether/Maleic isopropyl monoester | 9–10 |
| 9 | 2-(Phenoxy) ethyl vinyl ether/Maleic isopropyl monoester | 8–9 |
| 10 | 2-(4-Cyclohexyl phenoxy) ethyl vinyl ether/Maleic isopropyl monoester | 6–5 |
| 11 | 2-(2-Naphthyl) ethyl vinyl ether/Maleic isopropyl monoester | 7–8 |
| 12 (comparative) | (2-Naphthyl) methyl vinyl ether/Maleic isopropyl monoester | 0 |

TABLE 2

| Sample | Copolymer | Mol. Wt. | Coffee Stain Protection |
|---|---|---|---|
| 13 | 2-(2-Naphthoxy) ethyl vinyl ether/Maleic isopropyl monoester | $4.8 \times 10^3$ | 9–10 |
| 14 (comparative) | Poly 2-(2-Naphthoxy) ethyl acrylate | $2.9 \times 10^3$ | 2 |
| 15 (comparative) | Poly 2-(2-Naphthoxy) ethyl acrylate | $7.7 \times 10^3$ | 2 |
| 16 (comparative) | Poly 2-(2-Naphthoxy) ethyl acrylate | $14 \times 10^3$ | 2 |
| 17 | 2-(2-Naphthoxy) ethyl acrylate/Acrylic acid | $6 \times 10^3$ | 4 |
| 18 | 2-(2-Naphthoxy) ethyl acrylate/Maleic acid | $6 \times 10^3$ | 7–8 |

TABLE 3

| Sample | Copolymer | $T_g$[1](°C.) | $T_m$[2](°C.) | Coffee Stain Protection |
|---|---|---|---|---|
| 6 | 2-(5,6,7,8, Tetrahydro-2-naphthoxy) ethyl vinyl ether/Maleic isopropyl monoester | 98 | — | 8–9 |
| 4 | 2-(2-Naphthoxy) ethyl vinyl ether/Maleic isopropyl monoester | 50 | — | 9–10 |
| 10 | 2-(4-Cyclohexyl-phenoxy) ethyl vinyl ether/Maleic isopropyl monoester | 60 | 126 | 6–5 |

[1]Glass transition temperature.
[2]Melt temperature.

TABLE 4

| Samples | Copolymer | Yellowing (40 AATCC Fading Units) |
|---|---|---|
| 8 | Phenyl vinyl ether/Maleic isopropyl monoester | No yellowing |
| 9 | 2-(Phenoxy) ethyl vinyl ether/Maleic isopropyl monoester | No yellowing |
| 4 | 2-(2-Naphthoxy) ethyl vinyl ether/Maleic isopropyl monoester | Yellowing |
| 11 | 2-(2-Naphthyl) ethyl vinyl ether/Maleic isopropyl monoester | Yellowing |
| 6 | 2-(5,6,7,8-Tetrahydro-2-naphthoxy) ethyl vinyl ether/Maleic isopropyl monoester | Yellowing |
| 19 | 2-(4-Methyl-2-naphthoxy) ethyl vinyl ether/Maleic isopropyl monoester | Yellowing |
| 20 | 2-(5,6,7,8-Tetrahydro-2-naphthyl) ethyl vinyl ether/Maleic isopropyl monoester | Yellowing |

TABLE 5

| Sample | Copolymer | Coffee Stain Protection (%) Technique 2 Water Rinse | Detergent Rinse* |
|---|---|---|---|
| 4 | 2-(2-Naphthoxy ethyl vinyl ether)/Maleic isopropyl monoester | 55.8 | 74.3 |
| 21 | 2-(1-Naphthyl ethyl vinyl ether)/Maleic isopropyl monoester | 33.5 | — |
| 8 | Phenyl vinyl ether/Maleic isopropyl monoester | 64.2 | 89.4 |
| 9 | Phenoxy ethyl vinyl ether/ Maleic isopropyl monoester | 54.2 | — |

*5 minute wash with All-In-One detergent solution (7.5 g/l) at 60° C.

TABLE 6

| Sample | Copolymer | Coffee Stain Protection (%) Water Rinse[1] | Detergent Rinse[2] | FD&C Red Dye No. 40 Protection (%) |
|---|---|---|---|---|
| Blank[3] | — | 100 | — | 100 |
| Coffee Stained Control | — | 0 | — | — |
| Cherry Kool-Aid Stained Control | — | — | — | 0 |
| 22 | Phenyl vinyl ether/Maleic isopropyl monoester | 69 | 90 | 93 |
| 23* | Styrene/Maleic acid[4] | 18.3 | — | 77.9 |
| 24 | Phenyl vinyl ether/Maleic acid[5] | 32.7 | — | 99.3 |
| 25 | Phenyl vinyl ether/Maleic acid[6] | 21.1 | — | — |

*Comparative
[1]As set forth in Coffee Testing Protocol.
[2]Five minute wash with All-in-one detergent solution 7.5 g/l at 60° C.
[3]The blank was an untreated, unstained sample. It is given a value of 100% for protection since it is what a sample with 100% protection would look like.
[4]Hydrolysis product of the anhydride copolymer, number average molecular weight about 1600.
[5]Hydrolysis product of the anhydride copolymer, aqueous application at pH 5.
[6]Hydrolysis product of the anhydride copolymer, aqueous application at pH 5.8.

TABLE 7

| Sample | Copolymer | Gray Scale Rating* Lightfastness[1] (40 SFU[2]) | Ozone Fastness[3] (3 cycles) | Oxides of Nitrogen Fastness (1 cycle)[4] |
|---|---|---|---|---|
| Control | — | 3 | 1 | 3 |
| 22 | Phenyl vinyl ether/Maleic isopropyl monoester | 4 | 3–4 | 3 |

[1]AATCC 16E-1987.

[2]AATCC Standard fading unit.

[3]AATCC 129-1985.

[4]AATCC 164-1987.

*AATC Evaluation Procedure 1

We claim:

1. A composition useful in imparting coffee stain resistance to a textile substrate, said composition comprising a copolymer having the formula

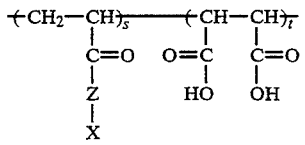

wherein s is 2 to 50 and t is 2 to 50, X is selected from the group consisting of phenyl, naphthyl, 5,6,7,8-tetrahydro-1-naphthyl and 5,6,7,8-tetrahydro-2-naphthyl, and Z is $-O-CH_2-CH_2-O-$, the copolymer having a weight average molecular weight between about 2,000 and 15,000.

2. The composition of claim 1 wherein X is selected from the group consisting of 1-naphthyl and 2-naphthyl.

3. The composition of claim 1 wherein X is phenyl.

4. The composition of claim 1 wherein X is phenyl.

* * * * *